US012454869B2

(12) United States Patent
Underbrink et al.

(10) Patent No.: US 12,454,869 B2
(45) Date of Patent: Oct. 28, 2025

(54) NON-PRESSURE SENSITIVE MODULE FOR LINER HANGER INSTALLATION

(71) Applicant: Schlumberger Technology Corporation, Sugar Land, TX (US)

(72) Inventors: Michael Underbrink, Eureka, MS (US); Nicholas Thomas, Rosharon, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/712,120

(22) PCT Filed: Nov. 1, 2022

(86) PCT No.: PCT/US2022/048525
§ 371 (c)(1),
(2) Date: May 21, 2024

(87) PCT Pub. No.: WO2023/101782
PCT Pub. Date: Jun. 8, 2023

(65) Prior Publication Data

US 2025/0020034 A1 Jan. 16, 2025

Related U.S. Application Data

(60) Provisional application No. 63/285,279, filed on Dec. 2, 2021.

(51) Int. Cl.
*E21B 23/04* (2006.01)
*E21B 43/10* (2006.01)

(52) U.S. Cl.
CPC ..... *E21B 23/042* (2020.05); *E21B 43/10* (2013.01)

(58) Field of Classification Search
CPC ..... E21B 43/10; E21B 23/042; E21B 23/00
See application file for complete search history.

(56) References Cited

U.S. PATENT DOCUMENTS 4,249,601 A 2/1981 White
4,390,065 A * 6/1983 Richardson ..... E21B 23/06 166/185

(Continued)

FOREIGN PATENT DOCUMENTS

WO 2021150458 7/2021

OTHER PUBLICATIONS

International Search Report and Written Opinion issued in PCT/US2022/048525 on Mar. 9, 2023.

*Primary Examiner* — Shane Bomar
(74) *Attorney, Agent, or Firm* — Jeffrey D. Frantz

(57) ABSTRACT

A non-pressure sensitive ("NPS") module. The NPS module may include a mandrel, a lug assembly, a release sleeve, and a retention mechanism. The mandrel may have fluid pathways that balance pressure uphole of the mandrel and downhole of the mandrel when the NPS module is positioned within the borehole. The lug assembly may extend at least partially through the mandrel, a lug of the lug assembly extendable through a port in the liner hanger to prevent setting of the liner hanger when the lug assembly is in a run-in position. The release sleeve may be coupled to the lug assembly and operable to shift the lug assembly from a run-in position to an intermediate position that allows the liner hanger to be set. The retention mechanism may be operable to prevent the lug assembly from shifting to a retracted position until run-in tool is pulled uphole.

20 Claims, 8 Drawing Sheets

(56) References Cited

U.S. PATENT DOCUMENTS

| | | | | |
|---|---|---|---|---|
| 6,739,398 | B1 * | 5/2004 | Yokley | E21B 34/142 166/123 |
| 7,766,088 | B2 | 8/2010 | Saucier et al. | |
| 2005/0006106 | A1 | 1/2005 | Hirth et al. | |
| 2007/0251704 | A1 * | 11/2007 | Reimert | E21B 43/10 166/208 |
| 2007/0272420 | A1 * | 11/2007 | Reimert | E21B 23/042 166/387 |
| 2008/0257560 | A1 | 10/2008 | Brisco et al. | |
| 2010/0038096 | A1 * | 2/2010 | Reimert | E21B 23/01 166/208 |
| 2010/0319927 | A1 * | 12/2010 | Yokley | E21B 43/10 166/373 |
| 2015/0101827 | A1 | 4/2015 | Abraham | |
| 2019/0040699 | A1 | 2/2019 | Perez et al. | |
| 2023/0055946 | A1 * | 2/2023 | Macin Moreno | E21B 23/0413 |

* cited by examiner

NON-PRESSURE SENSITIVE MODULE FOR LINER HANGER INSTALLATION

CROSS-REFERENCE TO RELATED APPLICATIONS

This application is a National Stage Entry of International Application No. PCT/US2022/048525, filed Nov. 1, 2022, which claims the benefit of U.S. Provisional Application No. 63/285,279 entitled "Non-Pressure Sensitive Module for Liner Hanger Installation," filed Dec. 2, 2021, the disclosure of which is incorporated herein by reference in its entirety.

BACKGROUND

In many well applications, a wellbore is drilled and a casing string is deployed along the wellbore. A liner hanger system may then be used to suspend liner/casing downhole within the casing string via a liner hanger. The liner hanger system may be a mechanically operated system or a hydraulically operated system. However, hydraulically operated systems generally have greater versatility and allow the liner to be rotated during running in hole.

While running in hole, fluid is circulated downhole under pressure to facilitate deployment of the liner. However, circulating the fluid at higher flow rates can generate high circulating pressures which run the risk of prematurely setting the liner hanger and/or releasing a run-in tool used to deploy the liner hanger. Attempts have been made to restrict such premature actuation, but current systems can be complicated or may not render the liner hanger system immune from premature hydraulic actuation.

SUMMARY

A non-pressure sensitive ("NPS") module for use with a liner hanger installable within a borehole via a run-in tool according to one or more embodiments of the present disclosure includes a mandrel, a lug assembly, a release sleeve, and a retention mechanism. The mandrel is positionable around a slick joint of the run-in tool and having one or more fluid pathways that balance pressure uphole of the mandrel and downhole of the mandrel when the NPS module is positioned within the borehole. The lug assembly is positionable around the slick joint and extending at least partially through the mandrel, a lug of the lug assembly extendable through a port in the liner hanger to prevent setting of the liner hanger when the lug assembly is in a run-in position. The release sleeve is positionable around the slick joint and coupled to the lug assembly, the release sleeve operable to shift the lug assembly from a run-in position to an intermediate position, the intermediate position allowing the liner hanger to be set. The retention mechanism is operable to prevent the lug assembly from shifting from the intermediate position to a retracted position until run-in tool is pulled uphole.

A liner hanger system for use in a borehole according to one or more embodiments of the present disclosure includes a liner hanger, a run-in tool comprising a slick joint, and an NPS module. The NPS module includes a mandrel, a lug assembly, a release sleeve, and a retention mechanism. The mandrel is positioned around the slick joint and having one or more fluid pathways that balance pressure uphole of the mandrel and downhole of the mandrel when the NPS module is positioned within the borehole. The lug assembly is positioned around the slick joint and extending at least partially through the mandrel, a lug of the lug assembly extendable through a port in the liner hanger to prevent setting of the liner hanger when the lug assembly is in a run-in position. The release sleeve is positioned around the slick joint and coupled to the lug assembly, the release sleeve operable to shift the lug assembly from a run-in position to an intermediate position, the intermediate position allowing the liner hanger to be set. The retention mechanism is operable to prevent the lug assembly from shifting from the intermediate position to a retracted position until run-in tool is pulled uphole.

A method of positioning a liner hanger within a well according to one or more embodiments of the present disclosure includes running a liner hanger into the well via a run-in tool comprising a slick joint. The method also includes positioning a lug assembly of an NPS module in a run-in position that prevents the liner hanger from setting. The method further includes creating a pressure differential between a bore of the slick joint and an annulus between the slick joint and a liner hanger mandrel of the liner hanger to shift a release sleeve of the NPS module positioned around the slick joint. The method also includes shifting the lug assembly of the NPS module from the run-in position to an intermediate position via the release sleeve to allow the liner hanger to be set. The method further includes setting the liner hanger.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

Figure 1:
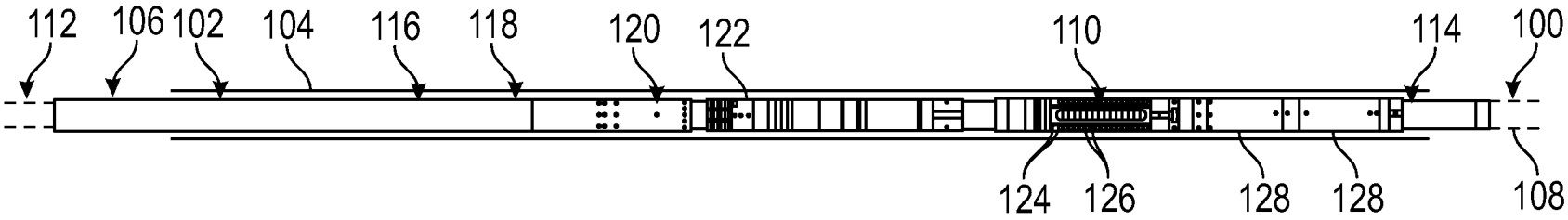
FIG. 1 is a liner hanger system being run into a borehole according to one or more embodiments of the present disclosure.

In the following description, numerous details are set forth to provide an understanding of some embodiments of the present disclosure. However, it will be understood by those of ordinary skill in the art that embodiments of the present disclosure may be practiced without these details and that numerous variations or modifications from the described embodiments may be possible.

In the specification and appended claims: the terms "connect," "connection," "connected," "in connection with,"

"connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

The disclosure herein generally involves a methodology and system for reducing or eliminating the risk of premature setting of a liner hanger system. According to an embodiment, the technique utilizes a liner hanger system having a running string and a liner hanger assembly. The liner hanger assembly comprises a liner hanger which may be actuated at a desired location within a borehole, e.g. within a casing. The liner hanger assembly further comprises a liner/casing which may be suspended from a surrounding casing string via the liner hanger.

The liner hanger system utilizes an NPS module which may be used in cooperation with the liner hanger to prevent premature actuation of the liner hanger. Additionally, the system may utilize features to avoid premature release of the liner hanger run-in tool. By way of example, the NPS module may use pressure equalization between a region within the running string and a region between the running string and the liner hanger to prevent pressure imbalances which could actuate the liner hanger. Additionally, a locking mechanism, e.g. a lug assembly, may be used to temporarily lock the liner hanger against premature actuation. According to an embodiment, the NPS module may be used to avoid premature setting of the liner hanger, while pressure equalization inside and outside the hanger run-in tool.

As described in greater detail below, the system helps enable circulation of fluids at relatively high rates and pressures during deployment of the liner and liner hanger. According to an embodiment, a running string that includes a run-in tool extends into the liner hanger and liner in a manner which creates an inner pressure region within the bore of the run-in tool and an intermediate pressure region between the run-in tool and the liner hanger. The configuration of the overall system allows pressure to substantially equalize within both regions. Additionally, the locking mechanism of the NPS module is used to mechanically lock the liner hanger against premature actuation. For example, the locking mechanism may be used to mechanically lock a hydraulic cylinder of the liner hanger in a run-in position.

The liner hanger may be set by dropping a ball down through the run-in tool to a ball seat to thus enable creation of a pressure differential between the inner pressure region and the intermediate pressure region. By relatively increasing the pressure within the inner pressure region, the locking mechanism is released to enable actuation of the liner hanger. In some embodiments, a shear member, e.g. shear screws, also may be used so that pressuring up the running string initially shears the shear screws.

Prior to dropping the ball, fluid circulation may be performed at desired rates within the system without risking premature shearing of the shear member or actuation of the liner hanger. Once the ball is dropped to temporarily plug the NPS module, however, a pressure differential can be created between the inner pressure region and the intermediate pressure region. The pressure differential may be continuous or established at different levels to achieve desired results, e.g. release of the locking mechanism to enable actuation of the liner hanger while also allowing release of the run-in tool. By way of example, the pressure differential may be used to first set the liner hanger and to subsequently release the running string for removal.

Referring now to FIG. 1, FIG. 1 is a liner hanger system 100 being run into a borehole 102, e.g. a wellbore, lined with or otherwise having a casing 104. In this embodiment, the liner hanger system 100 comprises a liner hanger assembly 106 having tubing 108, e.g. a liner string, coupled with a liner hanger 110. The overall liner hanger system 100 further comprises a releasable running string 112 which is releasably coupled with the liner hanger assembly 106. The liner hanger 110 works in cooperation with an NPS module 114 to prevent premature actuation/setting of the liner hanger 110 into engagement with the surrounding casing 104.

Depending on the parameters of a given operation, the liner hanger system 100 also may comprise other components/assemblies enabling interaction between the liner hanger assembly 106 and the run-in tool of the running string 112, described in more detail below. For example, the overall liner hanger system 100 may further comprise a pack off coupling section 116, an intermediate section 118, and a packer section 120. The packer section 120 may include a liner top packer assembly having a packer 122 which is part of or combined with the overall liner hanger assembly 106. In the illustrated example, the packer 122 is part of the liner hanger assembly 106 and is located below the intermediate section 118 and above the liner hanger 110. The packer section 120 may have a variety of configurations and may comprise various slips, sealing elements, and other components to facilitate actuation and engagement with the surrounding casing 104.

In the illustrated example, the liner hanger 110 comprises various features such as a cone 124 having inclined surfaces which interact with slips 126. The slips 126 may be coupled with one or more hydraulic cylinders 128. Once the liner hanger 110 is released for actuation via the NPS module 114, pressure applied down through the running string 112 may be used to actuate at least one of the cylinders 128 so as to shift the slips 126 linearly with respect to the cone 124. This relative linear movement of the slips 126 against the sloped surfaces of cone 124 effectively forces the slips 126 in a radially outward direction and ultimately into secure engagement with the surrounding casing 104.

Figure 2:
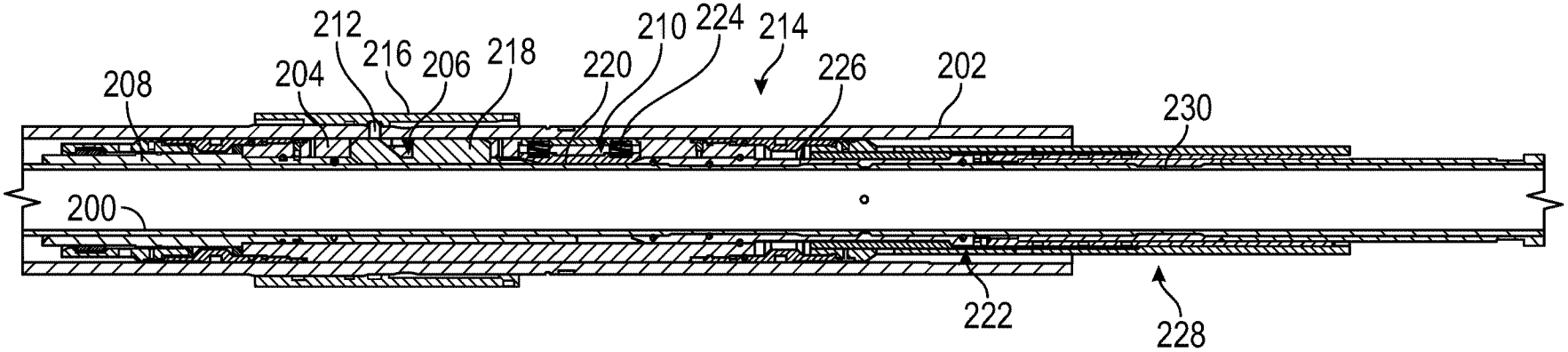
FIG. 2 is an NPS module according to one or more embodiments of the present disclosure.

Turning now to FIG. 2, FIG. 2 is an NPS module 214 according to one or more embodiments of the present disclosure. As described above, the NPS module 214 may be used with a liner hanger system to prevent premature setting of a liner hanger. The NPS module 214 is positioned within an annulus formed between a run-in tool slick joint 200 and a liner hanger mandrel 202. The NPS includes a mandrel 204, a lug assembly 206, a release sleeve 208, and a retention mechanism 210. The mandrel 204 includes one or more fluid pathways extending longitudinally through the mandrel to balance pressure uphole of the mandrel 204 and downhole of the mandrel 204 when the NPS module is positioned within the borehole, as shown in FIG. 1. By balancing the pressure uphole and downhole of the mandrel 204, the NPS module 214 is prevented from shifting from the initial run-in position, shown in FIG. 2, to the intermediate and retracted positions described in more detail below. Shear screws may also be utilized to prevent premature shifting of the release sleeve 208.

The lug assembly 206 includes a lug 212 that extends through a port in the liner hanger mandrel 202 and engages with a hydraulic cylinder 216 that shifts along the liner hanger mandrel 202 to set the liner hanger, as described above. The engagement between the lug 212 and the hydraulic cylinder 216 prevents the hydraulic cylinder 216 from shifting and setting the liner hanger. The lug assembly 206 also includes a ramp assembly 218 that is coupled to the release sleeve 208. The ramp assembly 218 is shaped to engage with the lug 212 such that longitudinal movement of the ramp assembly 218 will move the lug 212 in a radial direction.

The retention mechanism 210 includes a retainer 220 and a closure sleeve assembly 222. The retainer 220 is biased into engagement with the release sleeve 208 to limit the longitudinal movement of the release sleeve 208, as described in more detail below. In the illustrated embodiment, springs 224 bias the retainer 220; however, other similar methods may be used to apply a biasing force to the retainer 220. The closure sleeve assembly 222 includes a closure sleeve 226 and a latch assembly 228, such as a spring assembly or a collet, that engages with a recess 230 in the slick joint 200 as the slick joint 200 is pulled uphole to prevent further relative longitudinal movement between the closure sleeve 226 and the slick joint 200.

Figure 3:
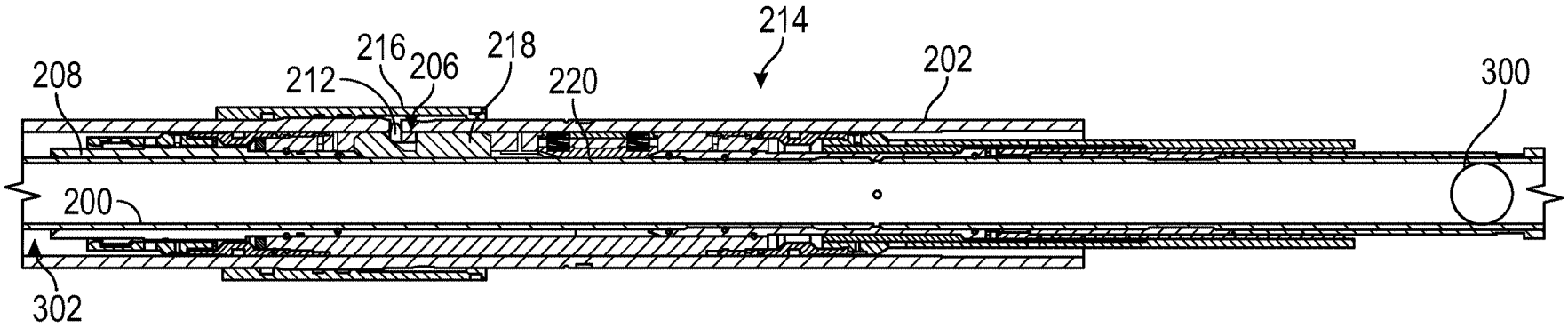
FIG. 3 is the NPS module of FIG. 2 an intermediate position.
Figure 4:
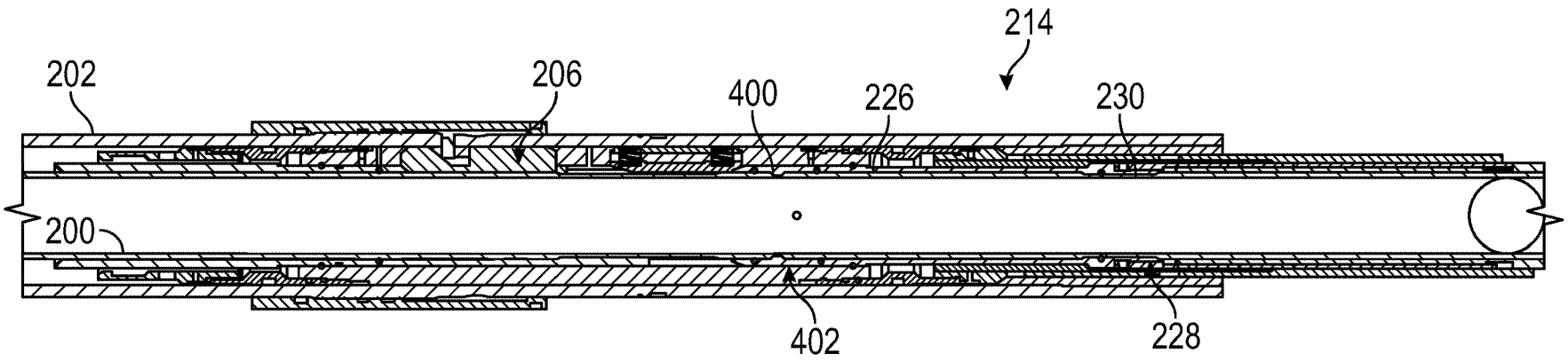
FIG. 4 is the NPS module of FIG. 3 with the slick joint shifted uphole.
Figure 5:
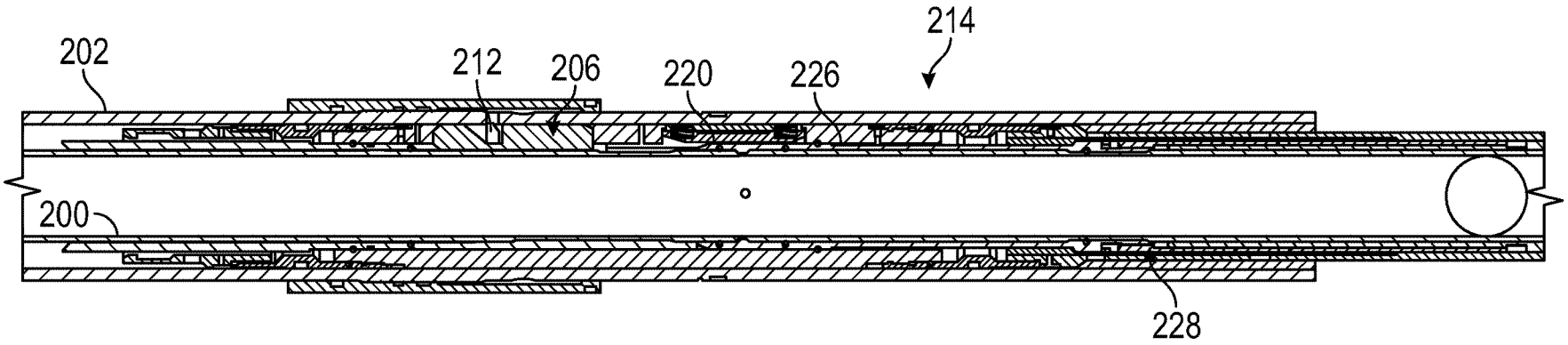
FIG. 5 is the NPS module of FIG. 4 in a retracted position.

Turning now to FIGS. 3-5, FIGS. 3-5 illustrate the actuation of the NPS module 214 of FIG. 2. To initiate actuation of the NPS module 214, a drop ball 300 is flowed downhole to plug the slick joint 200, as shown in FIG. 3. In other embodiments, a plug may be used in place of the drop ball 300 or the slick joint 200 may include an isolation valve to prevent flow through the bore of the slick joint. Once the drop ball 300 is positioned within the slick joint 200, a pressure differential is created between the bore of the slick joint 200 and the annulus 302 between the slick joint 200 and the liner hanger mandrel 202. This pressure differential causes the release sleeve 208 to shift uphole, shearing any shear screws retaining the release sleeve 208 in the run-in position.

The movement of the release sleeve 208 shifts the ramp assembly 218 uphole, which, in turn, retracts the lug 212 and positions the retention mechanism 210 in the intermediate position. As discussed above, the retainer 220 is engaged with the release sleeve 208. The retainer 220 allows limited longitudinal movement such that the release sleeve 208 and retention mechanism 210 can shift to the intermediate position, as shown in FIG. 3. However, the retainer 220 prevents further longitudinal movement of the release sleeve 208 and retention mechanism 210.

Once the retention mechanism 210 is in the intermediate position, the liner hanger hydraulic cylinder 216 can be shifted to set the liner hanger. Additionally, once the retention mechanism 210 is in the intermediate position, the slick joint 200 is shifted uphole, as shown in FIG. 4. As the slick joint 200 is shifted uphole, ports 400 in the slick joint 200 are aligned with a sealed portion 402 of the closure sleeve 226 to close the ports 400 and maintain the pressure differential between the bore of the slick joint 200 and the liner hanger mandrel 202 as the slick joint 200 is shifted uphole.

As discussed above, a recess 230 is formed in the slick joint 200. The recess 230 is positioned such that the latch assembly 228 engages with the recess 230 once the slick joint ports 400 are closed. Once engaged, the latch assembly 228 prevents relative longitudinal motion between the closure sleeve 226 and the slick joint 200.

Once the latch assembly 228 is engaged with the slick joint 200, the slick joint 200 is shifted further uphole, as shown in FIG. 5. The movement of the slick joint 200 shifts the closure sleeve 226 such that it disengages the retainer 220. The continued shifting of the slick joint 200 uphole shifts the lug assembly 206 into a retracted position where the lug 212 is fully withdrawn from the liner hanger mandrel 202. Once the lug 212 is fully withdrawn, the slick joint 200 and NPS module 214 can be withdrawn from the liner hanger.

Figure 6:
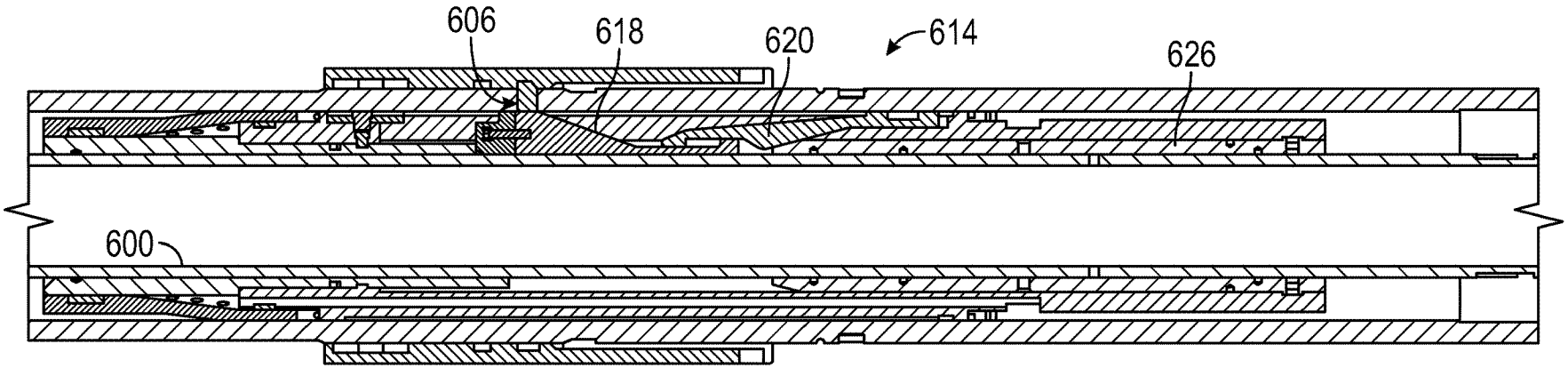
FIG. 6 is an NPS module according to one or more embodiments of the present disclosure.

Turning now to FIG. 6, FIG. 6 is an NPS module 614 according to one or more embodiments of the present disclosure. The NPS module 614 shown in FIG. 6 functions similarly to the NPS module 214 described above with reference to FIGS. 2-5. However, the retainer 620 of the NPS module 614 is a collet that engages with the ramp assembly 618 of the lug assembly 606 to prevent the lug assembly 606 from shifting from the intermediate position to the retracted position. The retainer 620 is opened via the closure sleeve 626 as the slick joint 600 is shifted uphole.

Figure 7:
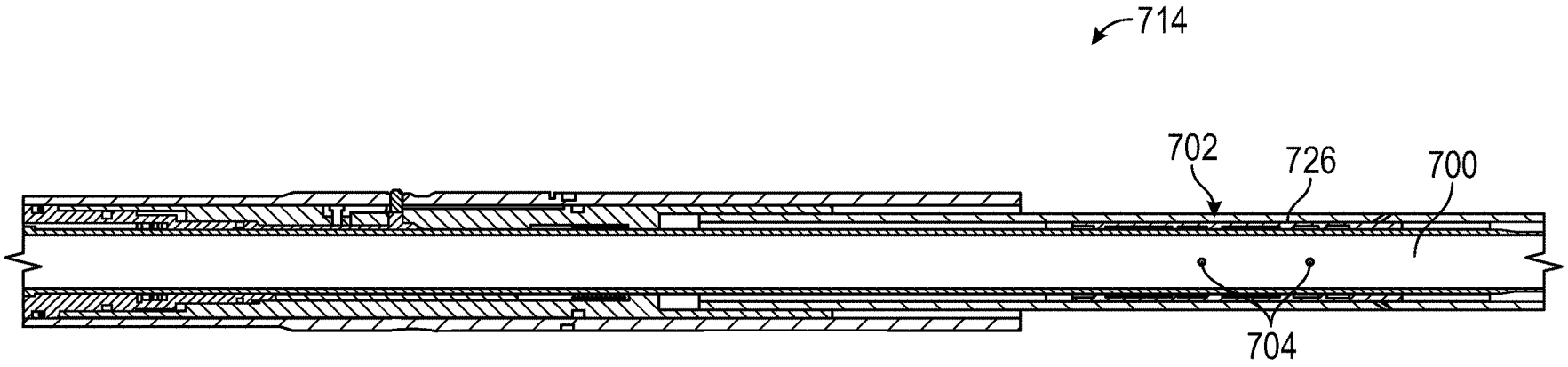
FIG. 7 is an NPS module according to one or more embodiments of the present disclosure.

Turning now to FIG. 7, FIG. 7 is an NPS module 714 according to one or more embodiments of the present disclosure. The NPS module 714. The NPS module 714 shown in FIG. 7 functions similarly to the NPS module 214 described above with reference to FIGS. 2-5. However, instead of shifting the slick joint 700 uphole to align the sealed portion 702 of the closure sleeve 726 with the ports 704 in the slick joint 700, the pressure within the slick joint 700 is increased. The increase in pressure shifts the closure sleeve 726 hydraulically and aligns the sealed portion 702 of the closure sleeve 726 with the ports 704 in the slick joint 700.

Figure 8:
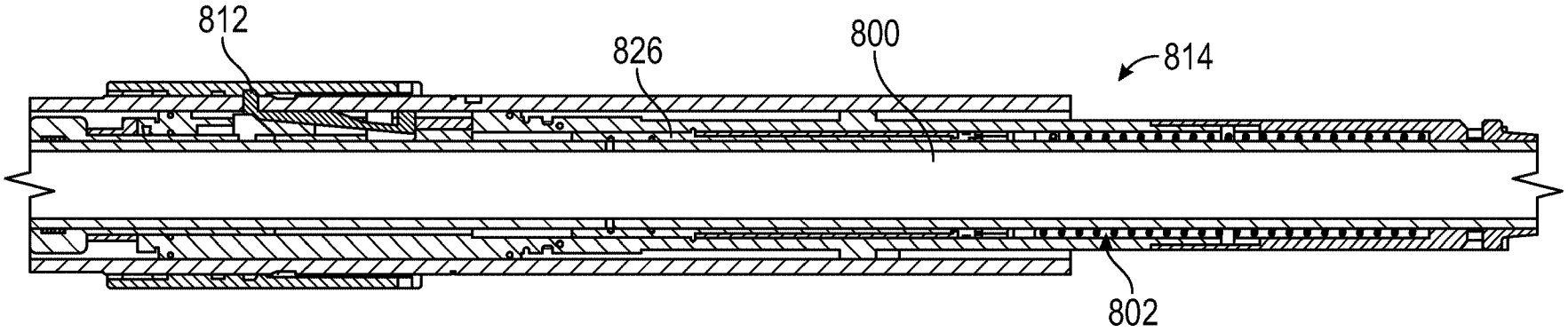
FIG. 8 is an NPS module according to one or more embodiments of the present disclosure.

Turning now to FIG. 8, FIG. 8 is an NPS module 814 according to one or more embodiments of the present disclosure. The NPS module 814. The NPS module 814 shown in FIG. 8 functions similarly to the NPS module 214 described above with reference to FIGS. 2-5. However, instead of the closure sleeve 826 shifting as the slick joint 800 is shifted uphole, the movement of the slick joint 800 uphole releases a spring mechanism 802. The spring mechanism 802 shifts the closure sleeve 826 and fully retracts the lug 812.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A non-pressure sensitive ("NPS") module for use with a liner hanger installable within a borehole via a run-in tool, the NPS module comprising:

a mandrel positionable around a slick joint of the run-in tool and having one or more fluid pathways that balance pressure uphole of the mandrel and downhole of the mandrel when the NPS module is positioned within the borehole;

a lug assembly positionable around the slick joint and extending at least partially through the mandrel, a lug of the lug assembly extendable through a port in the liner hanger to prevent setting of the liner hanger when the lug assembly is in a run-in position;

a release sleeve positionable around the slick joint and coupled to the lug assembly, the release sleeve operable to shift the lug assembly from a run-in position to an intermediate position, the intermediate position allowing the liner hanger to be set; and a retention mechanism operable to prevent the lug assembly from shifting from the intermediate position to a retracted position until run-in tool is pulled uphole.

2. The NPS module of claim 1, wherein the retention mechanism comprises:

a retainer engaged with at least one of the release sleeve or the lug assembly to prevent the lug assembly from shifting from the intermediate position to the retracted position; and a closure sleeve operable to disengage the retainer when run-in tool is pulled uphole.

3. The NPS module of claim 2, wherein the closure sleeve is engageable with the slick joint to close a port of the slick joint when run-in tool is pulled uphole.

4. The NPS module of claim 2, wherein the retainer is a collet that engages with the lug assembly to prevent the lug assembly from shifting from the intermediate position to the retracted position.

5. The NPS module of claim 2, wherein a spring biases the retainer into engagement with the release sleeve to prevent the lug assembly from shifting from the intermediate position to the retracted position.

6. The NPS module of claim 1, wherein the release sleeve shifts the lug assembly in response to a pressure differential between a bore of the slick joint and an annulus between the slick joint and a mandrel of the liner hanger.

7. The NPS module of claim 1, wherein the lug assembly is engageable with a hydraulic cylinder of the liner hanger to prevent setting of the liner hanger when the lug assembly is in a run-in position.

8. A liner hanger system for use in a borehole, the liner hanger system comprising:

a liner hanger;

a run-in tool comprising a slick joint; and a non-pressure sensitive ("NPS") module comprising:

a mandrel positioned around the slick joint and having one or more fluid pathways that balance pressure uphole of the mandrel and downhole of the mandrel when the NPS module is positioned within the borehole;

a lug assembly positioned around the slick joint and extending at least partially through the mandrel, a lug of the lug assembly extendable through a port in the liner hanger to prevent setting of the liner hanger when the lug assembly is in a run-in position;

a release sleeve positioned around the slick joint and coupled to the lug assembly, the release sleeve operable to shift the lug assembly from a run-in position to an intermediate position, the intermediate position allowing the liner hanger to be set; and a retention mechanism operable to prevent the lug assembly from shifting from the intermediate position to a retracted position until run-in tool is pulled uphole.

9. The liner hanger system of claim 8, wherein the retention mechanism comprises:

a retainer engaged with at least one of the release sleeve or the lug assembly to prevent the lug assembly from shifting from the intermediate position to the retracted position; and a closure sleeve operable to disengage the retainer when run-in tool is pulled uphole.

10. The liner hanger system of claim 9, wherein the closure sleeve is engageable with the slick joint to close a port of the slick joint when run-in tool is pulled uphole.

11. The liner hanger system of claim 9, wherein the retainer is a collet that engages with the lug assembly to prevent the lug assembly from shifting from the intermediate position to the retracted position.

12. The liner hanger system of claim 9, wherein a spring biases the retainer into engagement with the release sleeve to prevent the lug assembly from shifting from the intermediate position to the retracted position.

13. The liner hanger system of claim 8, wherein:

the liner hanger comprises a liner hanger mandrel; and the release sleeve shifts the lug assembly in response to a pressure differential between a bore of the slick joint and an annulus between the slick joint and the liner hanger mandrel.

14. The liner hanger system of claim 8, wherein:

the liner hanger comprises:

a liner hanger mandrel having a port; and a hydraulic cylinder; and the lug extends through the port and engages with the hydraulic cylinder to prevent setting of the liner hanger when the lug assembly is in a run-in position.

15. The liner hanger system of claim 14, wherein hydraulic pressure is applied to the hydraulic cylinder via the port to shift the hydraulic cylinder and set the liner hanger when the lug assembly is shifted to the intermediate position or the retracted position.

16. A method of positioning a liner hanger within a well, the method comprising:

running a liner hanger into the well via a run-in tool comprising a slick joint;

positioning a lug assembly of a non-pressure sensitive ("NPS") module in a run-in position that prevents the liner hanger from setting;

creating a pressure differential between a bore of the slick joint and an annulus between the slick joint and a liner hanger mandrel of the liner hanger to shift a release sleeve of the NPS module positioned around the slick joint;

shifting the lug assembly of the NPS module from the run-in position to an intermediate position via the release sleeve to allow the liner hanger to be set; and setting the liner hanger.

17. The method of claim 16, further comprising pulling the run-in tool uphole to a first position to release a retention mechanism of the NPS module that prevents the lug assembly from shifting from the intermediate position to a retracted position.

18. The method of claim 17, wherein releasing the retention mechanism comprises disengaging a retainer of the retention mechanism from at least one of the release sleeve or the lug assembly.

19. The method of claim 18, further comprising pulling the run-in tool uphole beyond the first position to shift the lug assembly to a retracted position and engage a closure sleeve of the retention mechanism with the slick joint to close a port of the slick joint.

20. The method of claim 18, wherein:

positioning a lug assembly of an NPS module in a run-in position comprises extending a lug of the lug assembly through a port of the liner hanger mandrel to engage with a hydraulic cylinder of the liner hanger; and setting the liner hanger comprises applying hydraulic pressure via the port to shift the hydraulic cylinder and set the liner hanger.

* * * * *